US006704532B2

(12) United States Patent
Takahashi et al.

(10) Patent No.: US 6,704,532 B2
(45) Date of Patent: Mar. 9, 2004

(54) METHOD FOR USING AN IMAGE FORMING APPARATUS USING LIQUID DEVELOPER

(75) Inventors: Masaki Takahashi, Kanagawa-ken (JP); Noriko Yamamoto, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/424,910

(22) Filed: Apr. 29, 2003

(65) Prior Publication Data

US 2003/0202824 A1 Oct. 30, 2003

Related U.S. Application Data

(62) Division of application No. 09/964,610, filed on Sep. 28, 2001, now Pat. No. 6,577,833.

(30) Foreign Application Priority Data

Sep. 29, 2000 (JP) ..... P2000-300992

(51) Int. Cl.[7] ..... G03G 15/10
(52) U.S. Cl. ..... 399/250; 399/251
(58) Field of Search ..... 399/250, 237, 399/238, 239, 251

(56) References Cited

U.S. PATENT DOCUMENTS 6,615,012 B2 * 9/2003 Yokota ..... 399/250
2002/0039501 A1 * 4/2002 Takahashi et al. ..... 399/250

FOREIGN PATENT DOCUMENTS

JP 8-334984 * 12/1996
JP 9-114345 * 5/1997

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A method for processing carrier vapor for an image forming apparatus using liquid developer. The method includes the step of sucking gas containing vapor of a carrier liquid vaporized in a cabinet of the image forming apparatus from one end of a pipe and ejecting the gas from another end of the pipe. The method further includes liquifying vapor of the vaporized carrier liquid using a liquifying device connected to the another end of the pipe, and ejecting the vapor not liquefied by the liquifying device using an ejection port.

20 Claims, 10 Drawing Sheets

METHOD FOR USING AN IMAGE FORMING APPARATUS USING LIQUID DEVELOPER

CROSS-REFERENCE TO RELATED APPLICATIONS

The patent application requests benefit of the priority on the basis of Japanese Patent Application 2000-300992 applied on Sep. 29, 2000. The contents of this patent application are all incorporated.

BACKGROUND OF THE INVENTION (1) Field of the Invention

The present invention relates to an image forming apparatus using liquid developer and more particularly to an image forming apparatus having a liquifying device for liquifying and collecting vapor of a carrier liquid generated in a cabinet.

(2) Description of the Related Art

Image forming apparatuses such as an electrophotographic recording device and an electrostatic recording device using a liquid developer have advantages which cannot be realized by a dry type image forming apparatus and the value thereof has been reviewed recently.

Main advantages of an image forming apparatus using liquid developer against a dry type image forming apparatus are that high image quality can be realized because these image forming apparatuses using a liquid developer can use extremely fine toner particles such as a sub-micron size, and the apparatuses are economical and can realize a texture like printing (for example, offset printing) because sufficient image density can be obtained by a small amount of toner, and energy conservation can be realized because toner can be fixed on a recording form at comparatively low temperature.

On the other hand, a conventional image forming apparatus using a liquid developer includes several essential problems, so that the dry type art has been unrivaled for a long period of time. As one of these problems, a problem concerning a carrier liquid used for a liquid developer may be cited.

Generally, a liquid used as a carrier liquid is a petroleum material and has an odor proper to the petroleum material. To prevent the odor from leaking from the cabinet, various methods are devised so as to collect and remove a carrier liquid.

For example, in Japanese Patent Application Laid-Open 11-249445, a method for press-fitting a cylindrical porous roller to the surface of an electrostatic latent image holding device on which a visible image is formed, thereby absorbs a carrier liquid on the surface of the electrostatic latent image holding device, decompresses the inside of the porous roller by a vacuum pump, thereby removes and collects the carrier liquid absorbed by the porous roller is disclosed.

For example, when the visible image from which the carrier liquid is removed and collected is transferred by feeding heat, the transfer efficiency is improved. However, the carrier liquid on the surface of the latent image holding device cannot be removed completely by the aforementioned removal and collection method, so that the carrier liquid remaining on the surface of the latent image holding device is vaporized by the heat at the time of transfer.

Further, in addition to heating at the time of transfer, there are various heat sources in the image forming apparatus and further, as a carrier liquid generally used, a highly volatile material is used, so that vapor of the carrier liquid is generated in the image forming apparatus during operation.

On the other hand, the image forming apparatus brings a carrier liquid into contact with the surface of the latent image holding device, forms a visible image, transfers the visible image onto a paper, and ejects the paper from the image forming apparatus via the paper ejection port. Therefore, it is difficult to enclose the image forming apparatus completely and vapor of the carrier liquid is diffused outside the image forming apparatus via the ejection port.

In such a problem, to prevent vapor of the carrier liquid from diffusion outside the image forming apparatus, various methods for collecting carrier liquid vapor have been proposed.

For example, there is a method available for bringing vapor of a carrier liquid into contact with an adsorbent such as activated carbon so as to adsorb it. However, the capacity of activated carbon for adsorbing vapor of a carrier liquid is only about 10 to 30% of the weight of activated carbon, so that to adsorb and collect vapor of the carrier liquid generated almost continuously during progress of the image forming process, a large amount of activated carbon must be loaded in the image forming apparatus and the image forming apparatus cannot be miniaturized.

Further, for example, in Japanese Patent Publication 6-58574, a method for sucking vapor of a carrier liquid into a liquifying device, cooling the liquifying device by a Peltier element (thermoelectric element), thereby liquifying the vapor of carrier liquid, and then collecting the carrier liquid in a liquid state is disclosed.

In this method, a power source for functioning the Peltier element must be installed separately. Further, when vapor of a carrier liquid is forcibly cooled by the Peltier element, water vapor coexisting with vapor of the carrier liquid is also liquified and the liquified and collected liquid is a mixture of carrier liquid and water. Namely, water not to be collected originally is also collected, so that problems arise that the container for holding a collected liquid is made larger and when the collected carrier liquid is to be reused for a developer, it must be separated from water once.

BRIEF SUMMARY OF THE INVENTION

As mentioned above, in the conventional method for re-liquifying, collecting, and removing vapor of a vaporized carrier liquid, a forced cooling device such as a piezoelectric element must be installed separately and there are various problems imposed in correspondence to it.

The present invention was developed with the foregoing problems in view and is intended to provide an image forming apparatus using liquid developer for removing vapor of a carrier liquid without using a forced cooling device.

An image forming apparatus using liquid developer of an embodiment of the present invention has a rotary latent image holding device, on the surface of which an electrostatic latent image is formed, a developing device for feeding a liquid developer containing toner particles and a carrier liquid to the electrostatic latent image, thereby forming a visible image on the latent image holding device, a transfer device for transferring the visible image to a transfer material, a cabinet for storing the latent image holding device, developing device, and transfer device, a pipe for sucking gas containing vapor of the carrier liquid vaporized in the cabinet from one end thereof and ejecting it from the other end, and a liquifying device which is connected to the other end of the pipe and has a sectional area 50 times or more of that of the pipe in the perpendicular direction to the moving direction of the vapor ejected from the pipe.

Further, in an image forming apparatus using liquid developer of another embodiment of the present invention having a rotary latent image holding device, on the surface of which an electrostatic latent image is formed, a developing device for feeding a liquid developer containing toner particles and a carrier liquid to the electrostatic latent image, thereby forming a visible image, a transfer device for transferring the visible image to a transfer material, a cabinet for storing the latent image holding device, developing device, and transfer device, and a liquifying device having a suction port for sucking gas containing vapor of the carrier liquid vaporized in the cabinet and an ejection port for ejecting the gas after liquifying the vapor, the liquifying device internally has a plurality of zigzag walls for changing the moving direction of the gas introduced from the suction port and leading the gas to the ejection port.

A carrier vapor processing device of an image forming apparatus using liquid developer of an embodiment of the present invention has a pipe for sucking gas containing vapor of a carrier liquid vaporized in a cabinet of the image forming apparatus using liquid developer from one end thereof and ejecting it from the other end, a liquifying device connected to the other end of the pipe for liquifying vapor of the vaporized carrier liquid, and an ejection port for ejecting the vapor not liquified by the liquifying device.

DETAILED DESCRIPTION OF THE INVENTION

Figure 1:
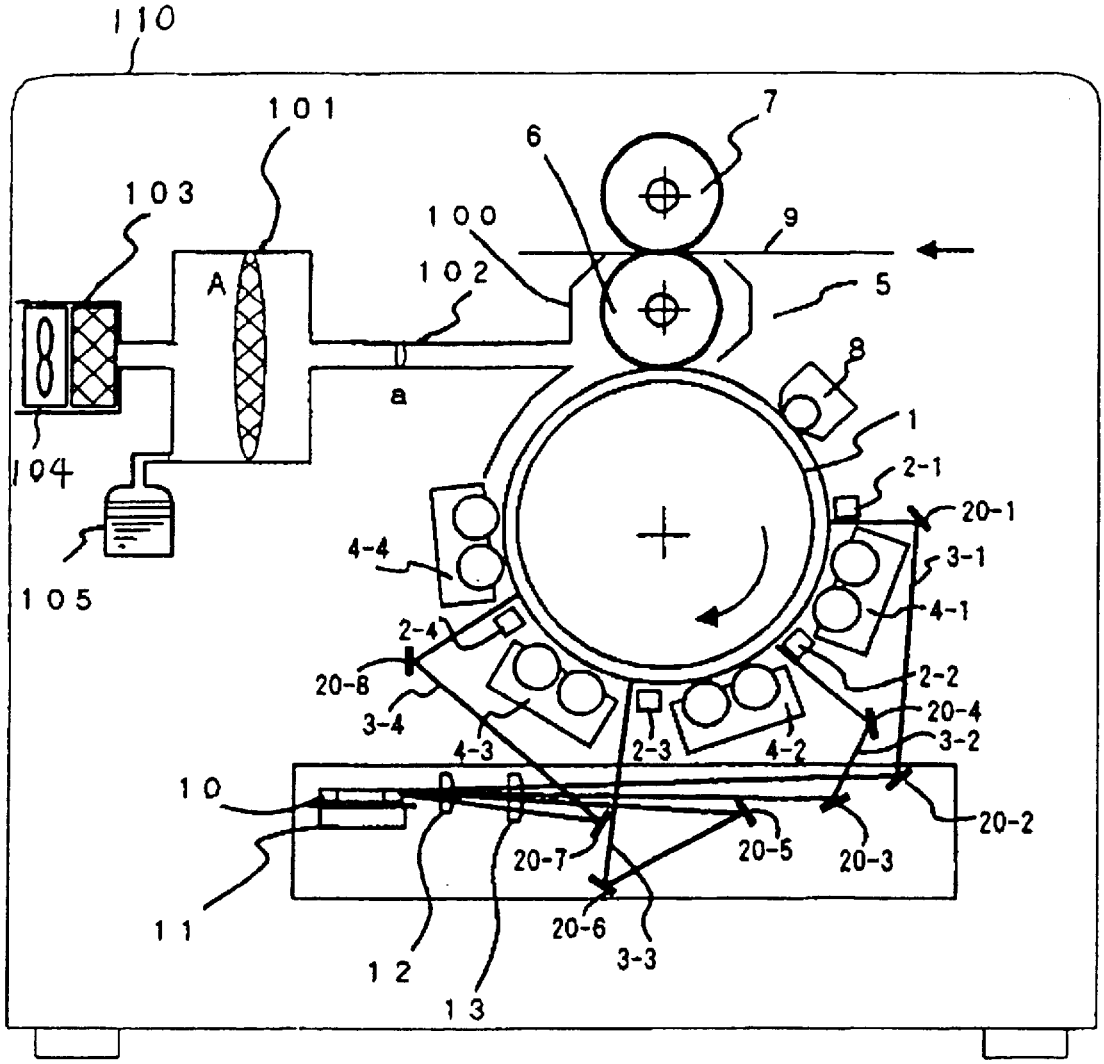
FIG. 1 is a drawing of an image forming apparatus showing an example of the first embodiment of the present invention and FIG. 2 is a projection view showing an example of a liquifying device relating to the first embodiment of the present invention.

As an example of the first embodiment of an image forming apparatus using a liquid developer, a schematic view of an electrophotographic apparatus using liquid developer is shown in FIG. 1 and this embodiment of the present invention will be explained hereunder with reference to the accompanying drawings.

In the drawing, as a latent image holding device 1 having a photosensitive layer on its surface, for example, a photosensitive drum having an organic or amorphous silicon series photosensitive layer may be used on a conductive rigid substrate such as aluminum. Furthermore, it is preferable to install a release layer on the uppermost surface of the photosensitive layer and suppress toner particles from adhering to the latent image holding device. In FIG. 1, the roller-shaped latent image holding device 1 is used for explanation. However, for example, a rotary latent image holding device that the elastic belt is shaped in a ring and a photosensitive layer is formed on the surface of the elastic belt may be adopted.

The latent image holding device 1 rotates in the direction of the arrow, is charged by a charger 2-1, and then selectively exposed by a laser beam 3-1. As a result, on the surface of the latent image holding device 1, an electrostatic latent image composed of a charge area and an area that the charged amount is reduced due to exposure is formed.

The laser beams 3-1 to 3-4 are light which is emitted from the respective light sources, reflected by a polygon mirror 10, and beamed by fθ lenses 12 and 13 and moreover, the laser beam 3-1, the laser beam 3-2, the laser beam 3-3, and the laser beam 3-4 are reflected respectively by mirrors 20-2 and 20-1, mirrors 20-3 and 20-4, mirrors 20-5 and 20-6, and mirrors 20-7 and 20-8 and expose the electrostatic latent image at predetermined positions. The polygon mirror 10 is rotated by a polygon motor 11, thereby scans the respective laser beams in the direction of the vertical face to the moving direction of the latent image holding device 1.

The electrostatic latent image formed on the surface of the electrostatic latent image holding device 1 is developed by a developing device 4-1. The developing device 4-1 has a container for storing a liquid developer and a roller-shaped developing electrode which is arranged so as to be opposite to the latent image holding device 1 in non-contact with each other and applied with a developing voltage. When the roller-shaped developing electrode is rotated, the liquid developer is transferred between the developing electrode and the latent image holding device 1 and the latent image is developed to a visible image.

Further, a roller-shaped fog removal electrode is installed on the downstream side of the developing electrode and a potential for sucking toner particles remaining in the non-image part can be applied to this electrode. Further, the carrier liquid in the liquid developer is scraped by this roller and the excessive amount of carrier liquid can be reduced beforehand.

The liquid developer contains a non-polarity carrier liquid such as ISOPAR L manufactured by Exxon Mobil Chemical Company and toner particles with a diameter of 0.1 $\mu$m to 2 $\mu$m dispersed in the carrier liquid. When the developing voltage is applied to the developing electrode, toner particles are deposited according to the electrostatic latent image, thus a visible image of the first color is formed.

The developing devices 4-1, 4-2, 4-3, and 4-4 are different from each other in toner particles in different colors, though the developing devices 4-2, 4-3, and 4-4 have the same constitution as that of the developing device 4-1. The chargers 2-2, 2-3, and 2-4 have the same constitution basically as that of the charger 2-1 and the exposure devices 3-2, 3-3, and 3-4 have the same constitution basically as that of the exposure device 3-1. The charger 2-2, the exposure device 3-2, and the developing device 4-2 form a visible image of the second color on the visible image of the first color, and in the same way, the charger 2-3, the exposure device 3-3, and the developing device 4-3 form a visible image of the third color on the visible image of the second color, and furthermore, the charger 2-4, the exposure device 3-4, and the developing device 4-4 sequentially laminate a visible image of the fourth color on the visible image of the third color.

In this way, on the surface of the electrostatic latent image holding device 1, toner particles for forming a visible image and a carrier liquid left unremoved exist.

The toner particle image (visible image) on the surface of the latent image holding device 1 is transferred to an intermediate transfer medium 6 such as an intermediate transfer drum. As a transfer method in this case, a transfer method by pressure (pressure and heat as required) and an electrostatic transfer method may be cited.

In a case of transfer by pressure, the intermediate transfer medium 6 is press-fit to the latent image holding device 1 and toner particles on the surface of the latent image holding device 1 are transferred to the intermediate transfer medium 6 using the tackiness of toner particles. Particularly when toner particles on the surface of the latent image holding device 1 are to be transferred to a transfer material such as the intermediate transfer medium 6 using such tackiness of toner particles, by transferring in a state that there is little carrier liquid on the surface of the latent image holding device, the transfer efficiency can be improved particularly.

Therefore, it is effective to arrange a heater (not shown in the drawing) between the developing device 4-4 and the intermediate transfer medium 6, vaporize the carrier liquid on the surface of the latent image holding device 1, thereby remove the carrier liquid on the surface of the electrostatic latent image holding device. Further, it is also effective to heat the intermediate transfer medium 6 and increase the tackiness of toner particles in order to improve the transfer efficiency.

In the electrostatic transfer method, potential for attracting toner particles constituting the visible image to the intermediate transfer medium 6 is supplied to the intermediate transfer medium 6, thus toner particles in the carrier liquid are subjected to electrophoresis onto the surface of the intermediate transfer medium 6. In this case, a carrier liquid is also deposited on the surface of the intermediate transfer medium 6. When the carrier liquid 6 remains as it is, the carrier liquid permeates into a form 9. Therefore, it is preferable to vaporize the carrier liquid on the surface of the intermediate transfer medium 6 and remove the carrier liquid before making contact with the form.

The visible image transferred to the intermediate transfer medium 6 is transferred to a recording medium such as the paper 9 transferred by being held between the intermediate transfer medium 6 and a pressure body 7 and the paper 9 is ejected outside a cabinet 110.

After transfer, on the surface of the latent image holding device 1, toner particles partially remain untransferred. The toner particles remaining untransferred are removed by a cleaner 8 and then a series of image forming processes is finished. And, the next developing process is executed in a state that there are no toner particles on the surface of the latent image holding device 1.

For example, in the electrophotographic apparatus using liquid developer shown in FIG. 1, vapor of the carrier liquid in the cabinet 110 is mainly generated by vaporization of the carrier liquid on the surface of the latent image holding device or vaporization of the carrier liquid on the surface of the intermediate transfer medium 6.

In this embodiment of the present invention, a liquifying device 101 for liquifying and collecting vapor of the carrier liquid generated in the cabinet like this is arranged.

Collection of carrier liquid vapor using the liquifying device 101 will be explained hereunder.

In FIG. 1, a collection hood 100 is installed between the developing device 4-4 and the intermediate transfer medium 6 where a large amount of carrier liquid vapor is generated and arranged so as to prevent vapor of a carrier liquid with high density from diffusion.

The collection hood 100 is connected to one end of a pipe 102. The other end of the pipe 102 is connected to the liquifying device 101. Furthermore, the liquifying device 101 is connected to a fan 104.

Namely, gas containing vapor of the carrier liquid existing in the collection hood 100 is sucked by the pipe 102 and sucked from the connection between the pipe 102 and the liquifying device 101, that is, the suction portion of the liquifying device into the liquifying device 101 and furthermore, the gas in the liquifying device 101 is ejected from the connection with the fan 104, that is, the ejection port of the liquifying device outside the cabinet 110.

Basically, the carrier vapor processing device is composed of the pipe 102, the liquifying device 101, and the ejection port.

The liquifying device 101 relating to this embodiment of the present invention is characterized in that the sectional area A of the gas flow path of the aforementioned gas containing vapor ejected from the pipe 102 into the liquifying device 101, that is, the sectional area in the perpendicular direction to the moving direction of gas is 50 times or more of the sectional area a of the pipe 102.

Figure 2:
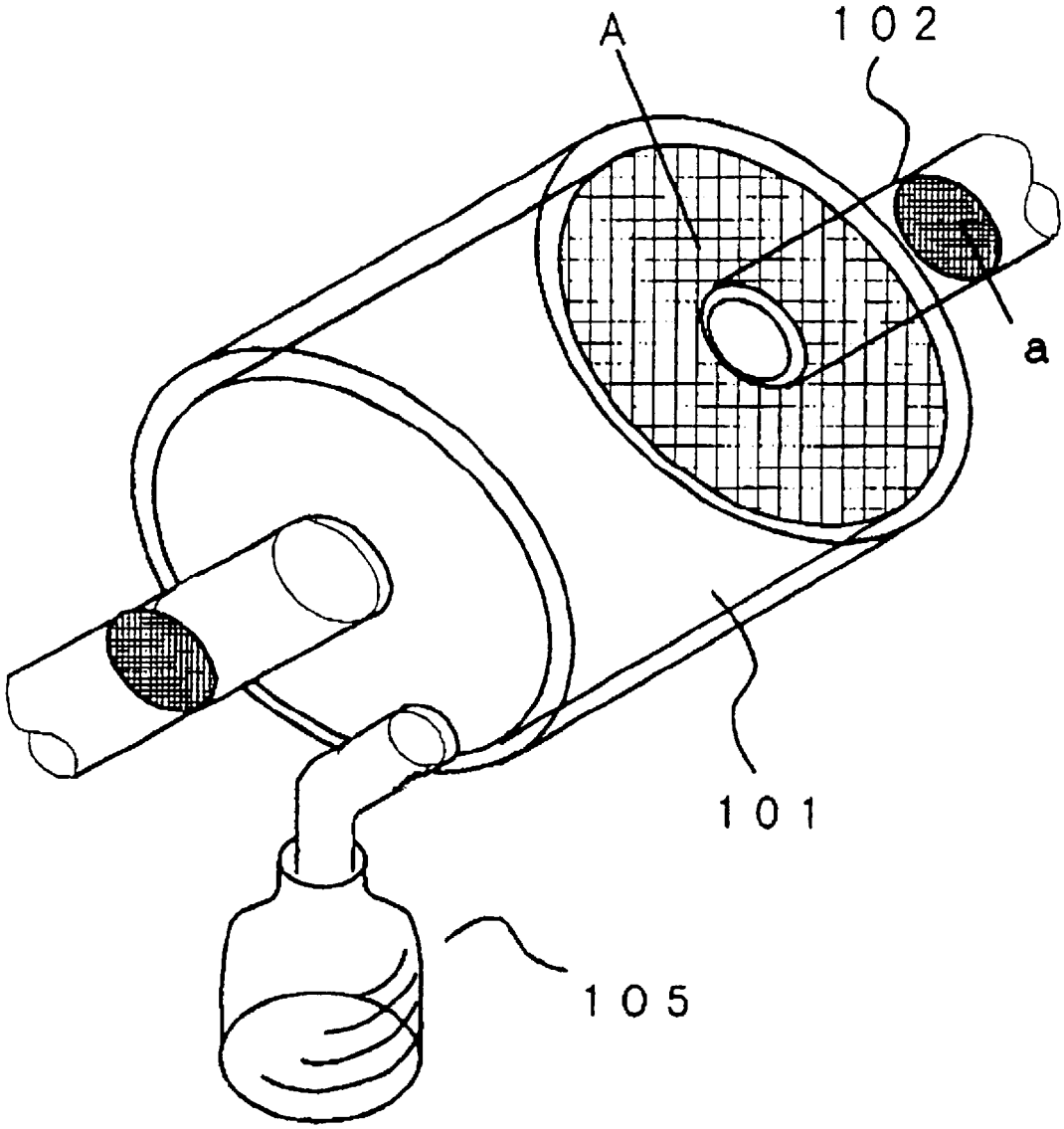

FIG. 2 is an enlarged perspective view showing an example of the circumference of the liquifying device 101.

The gas containing solvent vapor ejected from the pipe 102 into the liquifying device 101 is cooled by adiabatic expansion and as a result, carrier liquid vapor is liquified by dew condensation. The liquified carrier liquid drops in the liquifying device by its own weight. When a carrier liquid collection container 105 is connected to the bottom of the liquifying device 101, the carrier liquid can be collected selectively. The reason will be explained hereunder.

The water vapor amount contained in gas introduced into the liquifying device 101 is the water vapor amount contained in the atmosphere, that is, an amount for maintaining the air phase condition in the room temperature environment, so that even if the temperature in the liquifying device 101 is reduced to the room temperature, the water vapor component in the aforementioned gas is not liquified. On the other hand, carrier liquid vapor is generated in a heated state, so that the carrier liquid vapor amount in gas exceeds the saturated vapor amount in the room temperature environment.

For example, when the carrier liquid vapor amount in a heated state reaches the saturated vapor amount, if the gas temperature is reduced (higher than the room temperature), the water vapor is not liquified and only the carrier liquid can be liquified selectively.

However, the carrier liquid vapor amount generated in the actual image forming process is about 90% of the saturated vapor amount, so that when the sectional area A is smaller than 50 times of the sectional area a, carrier liquid vapor is not sufficiently cooled so as to be liquified.

On the other hand, the sectional area A, in consideration of the use energy efficiency of the fan used to collect a carrier liquid, is set to 1500 times or less of the sectional area a of the pipe 102. The aforementioned gas which is generally reduced to about 60° C. cannot be cooled to the room temperature or less by adiabatic expansion on such a level.

Further, in FIG. 2, the pipe 102 is connected to almost the central part of the liquifying device 101. Namely, the cylindrical liquifying device 101 and the pipe 102 are arranged almost concentrically with each other. When the pipe 102 is connected to the central part of the liquifying device 101 like this, the rate of adiabatic expansion of gas ejected from the pipe 102 into the liquifying device 101 can be increased and the carrier liquid collection efficiency can be improved as well.

Further, the carrier liquid collected by the carrier liquid collection container 105 may be returned to the developing devices 4-1 to 4-4 again and re-used or may be used as a liquid for wiping by the cleaner 8.

Further, there is a possibility that an extremely small amount of carrier liquid vapor unliquified may remain in gas ejected from the liquifying device 101 outside the cabinet. As shown in FIG. 1, an adsorbent 103 such as activated carbon is arranged between the liquifying device 101 and the fan 104 as required and the amount of carrier liquid vapor ejected from the cabinet can be reduced.

Next, the second embodiment of the present invention will be explained.

Figure 3:
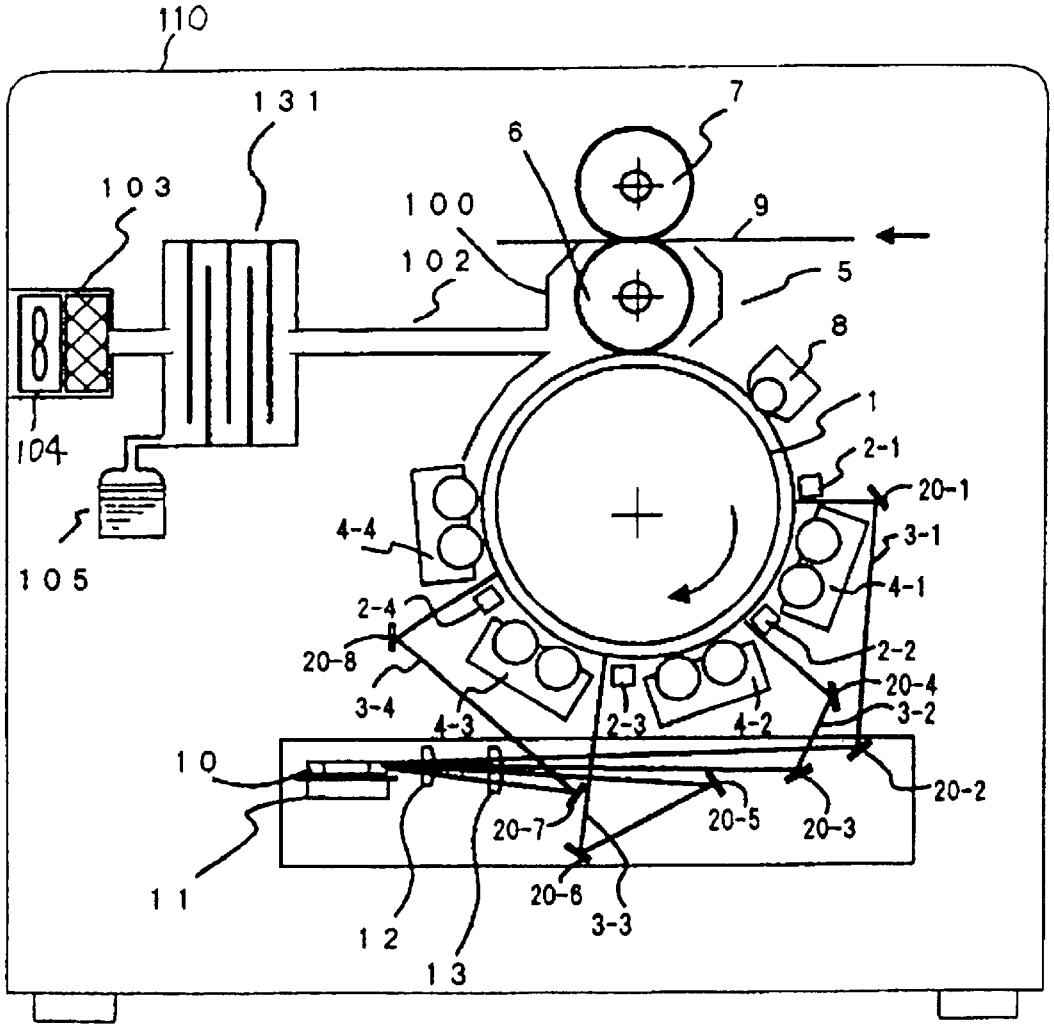
FIG. 3 is a drawing of an image forming apparatus showing an example of the second embodiment of the present invention and FIG. 4 is a projection view showing an example of a liquifying device relating to the second embodiment of the present invention.

FIG. 3 is a schematic view of an electrophotographic apparatus using liquid developer showing the second embodiment of the present invention.

In the electrophotographic apparatus using liquid developer shown in FIG. 3, the structure of a liquifying device 131 is different from the structure of the liquifying device 101 of the image forming apparatus using liquid developer shown in the first embodiment. The other points are the same as those of the first embodiment and the explanation of the same numerals shown in the drawing is simplified.

The liquifying device 131 shown in FIG. 3 is different from the liquifying device 101 shown in the first embodiment in a point that it internally has a plurality of zigzag walls 132.

In the liquifying device 131, the ejection port connected to the fan 104 and the suction port connected to the pipe 12 are installed, and the liquifying device 131 is internally decompressed by the fan, thus carrier liquid vapor is sucked from the suction port.

Gas containing carrier liquid vapor sucked from the pipe 102 into the liquifying device 131 collides sequentially with the zigzag wall 132 installed in the liquifying device, the inner wall of the liquifying device 131, the zigzag wall 132 arranged next, the inner wall of the liquifying device 131, - - - , meanders from the suction port to the ejection port by changing its moving direction, and is ejected from the ejection port outside the cabinet 110.

On the other hand, the liquifying device 131 is arranged away from the heat generation source such as the intermediate transfer medium 6, thereby cooled naturally and gas containing carrier liquid vapor makes contact with the zigzag wall 132 or the inner wall of the liquifying device 131 and is cooled, condensed into dewdrops, and liquified.

The second embodiment of the present invention is characterized in that gas containing carrier liquid vapor meanders in the liquifying device to the ejection port. The apparatus is structured so as to allow the aforementioned gas to collide with the zigzag wall 132 or the inner wall of the liquifying device 131, thus a microscopic turbulent flow is generated in gas containing carrier liquid vapor, so that the contact probability with the zigzag wall which is a refrigerant or the inner wall of the liquifying device is increased.

As a result, carrier liquid vapor can be liquified efficiently without lowering the refrigerant temperature extremely. Furthermore, there is no need to lower the refrigerant temperature extremely, so that liquifying of water vapor contained in the aforementioned gas can be reduced.

Figure 4:
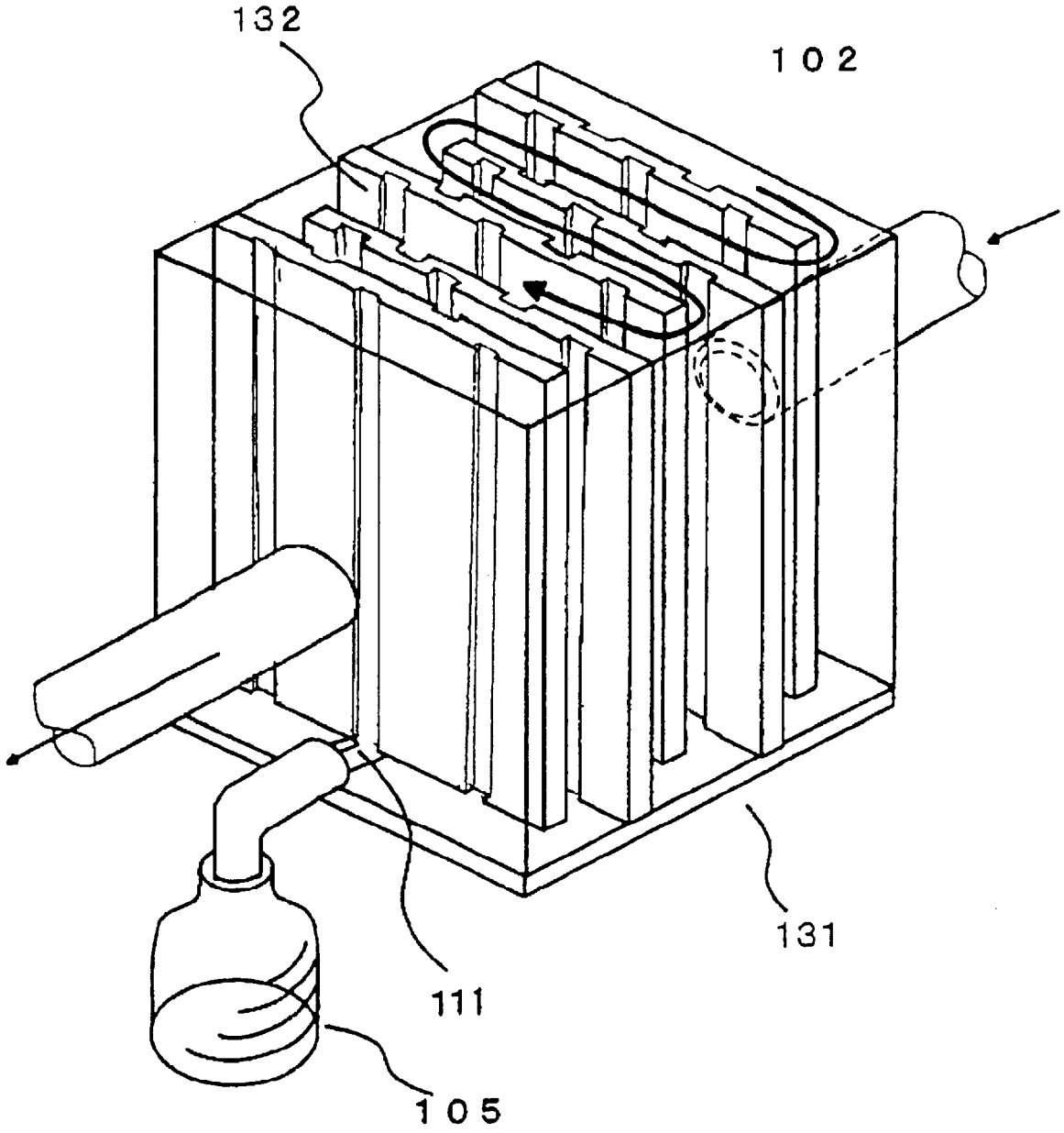
Figure 5:
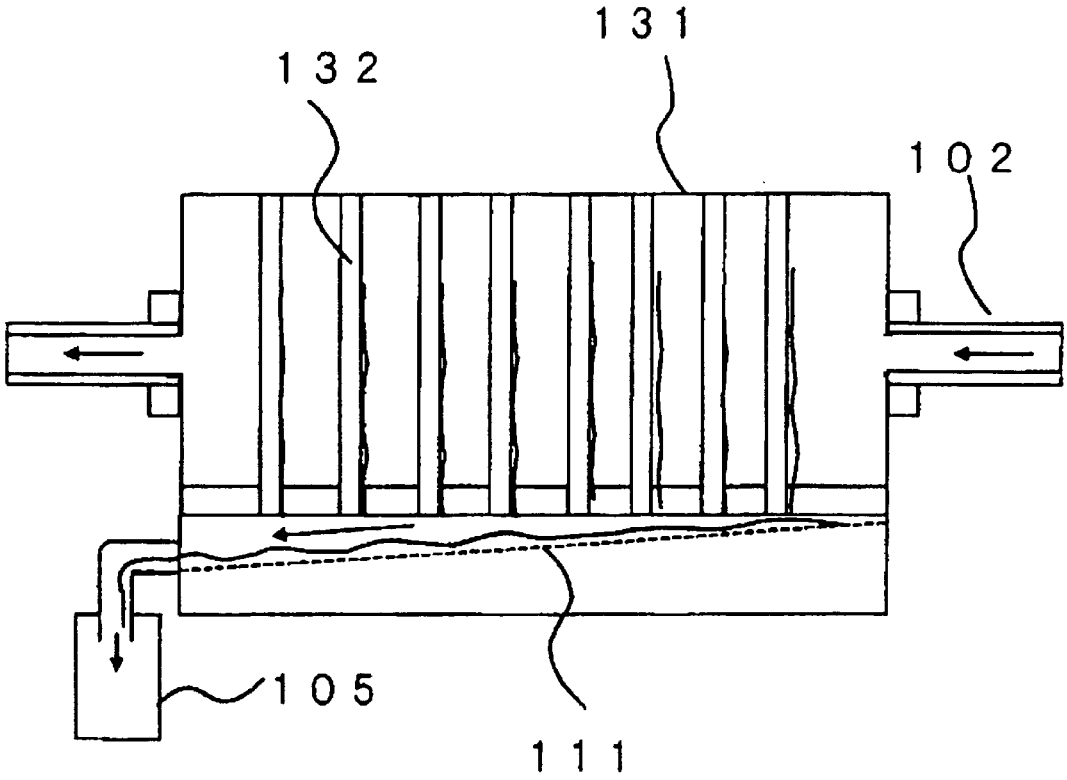
FIG. 5 is a projection view showing an example of a liquifying device relating to the second embodiment of the present invention and FIG. 6 is a cross sectional view of the liquifying device shown in FIG. 5.

FIG. 4 is a projection view of a liquifying device relating to the second embodiment of the present invention, and FIG. 5 is a cross sectional view thereof, and a collection method for a carrier liquid will be explained more in detail using those drawings.

As mentioned above, gas containing carrier liquid vapor is sucked from the pipe. 102 and threads its way through the zigzag walls 132 arranged in a nesting state.

The zigzag walls 132 are arranged so that the surfaces in contact with the aforementioned gas are parallel with the direction of the gravity, so that the liquified carrier liquid drops on the bottom of the liquifying device 131 by its own weight. In the bottom of the liquifying device 131, a slit 111 of the carrier liquid flow path inclined downward the carrier liquid collection container 105 is formed and a carrier liquid dropping on the bottom of the liquifying device 131 passes along the slit 111 and is collected by the carrier liquid collection container 105.

Further, on the surfaces of the zigzag walls 132 shown in FIG. 4, slits having a perpendicular component to the moving direction (shown by the arrow) of the aforementioned meandering gas, for example, slits installed in the vertical direction are formed and a turbulent flow is surely generated by the aforementioned gas via the slits.

Figure 6:
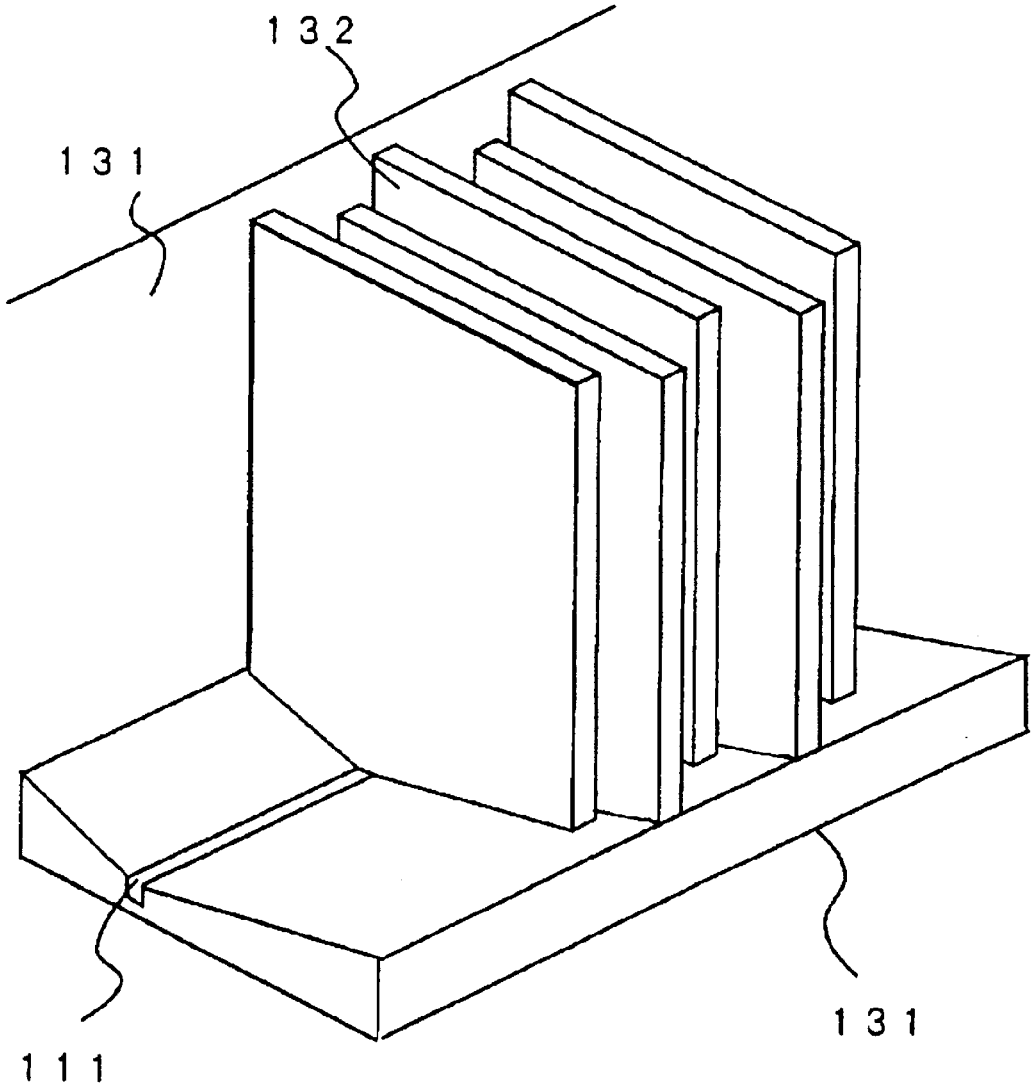
Figure 7:
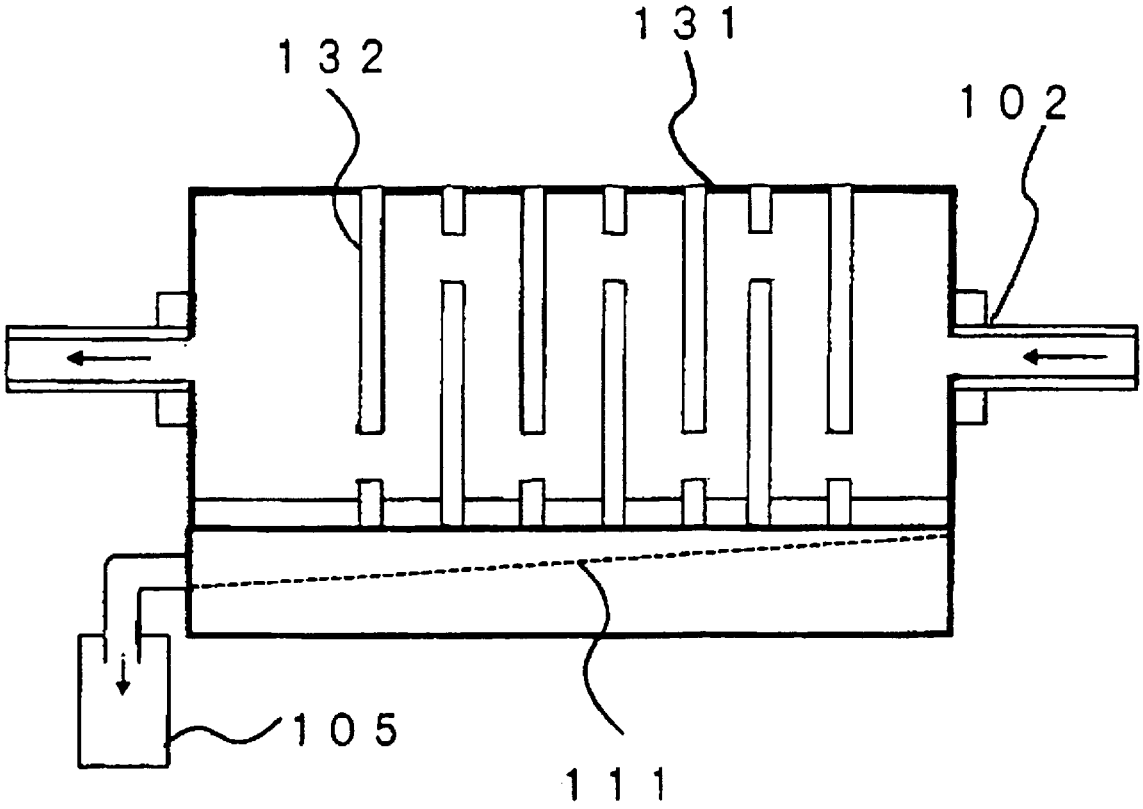
FIG. 7 is a projection view showing another example of a liquifying device relating to the second embodiment of the present invention and FIG. 8 is a projection view showing still another example of a liquefying device relating to the second embodiment of the present invention.
Figure 8:
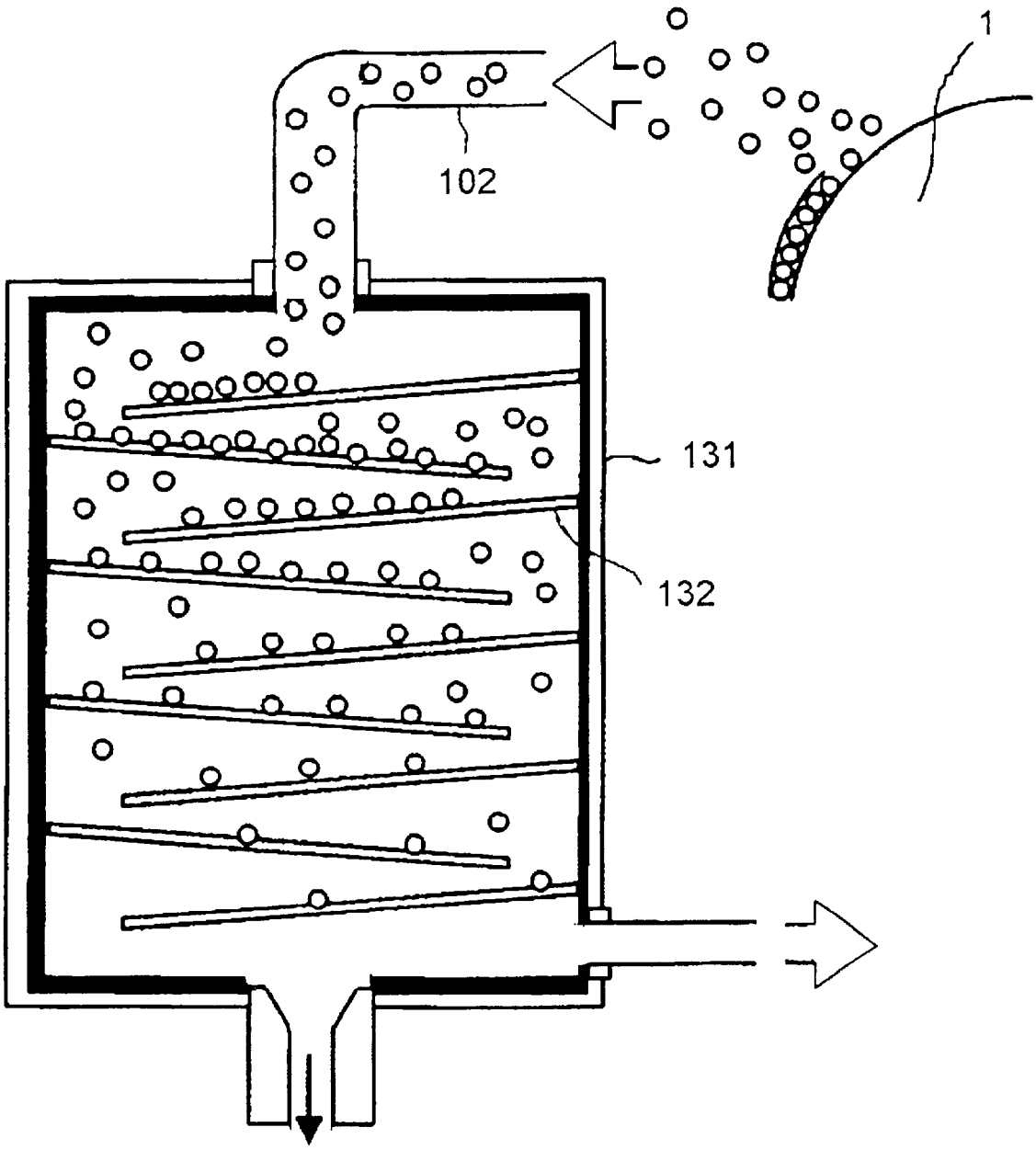

Deformation examples of the liquifying device 131 relating to the second embodiment of the present invention are shown in FIGS. 6 to 8.

The bottom of the liquifying device 131 shown in FIG. 6 is formed so as to be inclined toward the slit 111 of the carrier liquid flow path. Since such an inclined part is provided in the bottom, a liquified carrier liquid can be collected promptly in the slit and furthermore in the carrier liquid collection container 105.

For example, when a carrier liquid remains in the liquifying device 131 after the fan 104 is stopped, there is a possibility that the carrier liquid may be vaporized again and leak from the cabinet. However, the inclined part is provided in the bottom of the liquifying device 131 and no carrier liquid remains on the bottom, so that a leak of carrier liquid vapor from the cabinet can be suppressed more.

In FIG. 7, a plurality of zigzag walls having a vent hole 133 respectively are arranged. By use of such a structure, the strength of the liquifying device. 131 can be increased. However, in this case, no vent hole 133 is provided at the same position of any neighboring zigzag walls 132 and the zigzag walls are arranged so that gas ejected from one vent hole 133 collides with the next zigzag wall 132 and then moves to the next vent hole.

FIG. 8 shows an example that a plurality of zigzag walls 132 are arranged respectively with a slope in the liquifying device 131. When the zigzag walls 132 are inclined like this, a liquified carrier liquid can be efficiently collected even if the zigzag walls are not arranged vertically.

The inventors ascertained the carrier liquid collection effect due to arrangement of these zigzag walls 132 by the following experiment.

Figure 9:
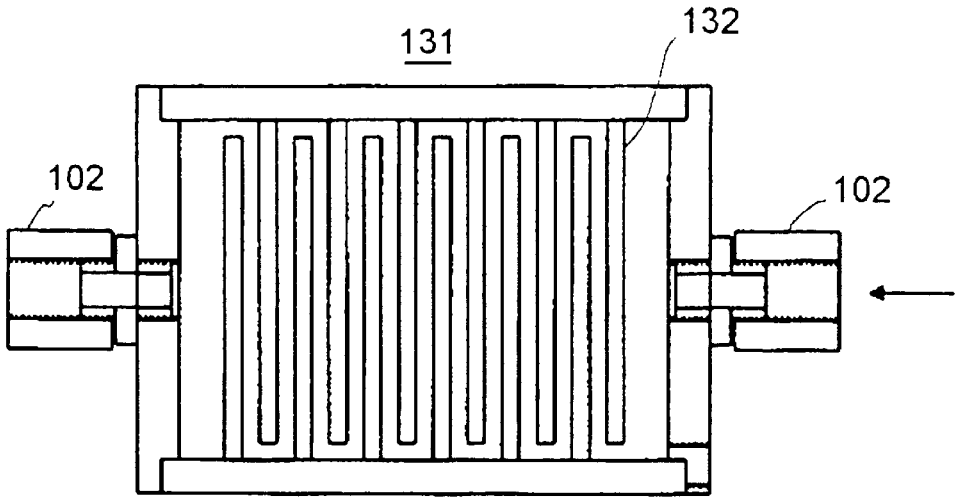
FIG. 9 is a cross sectional view of a liquifying device used in the first experiment.
Figure 10:
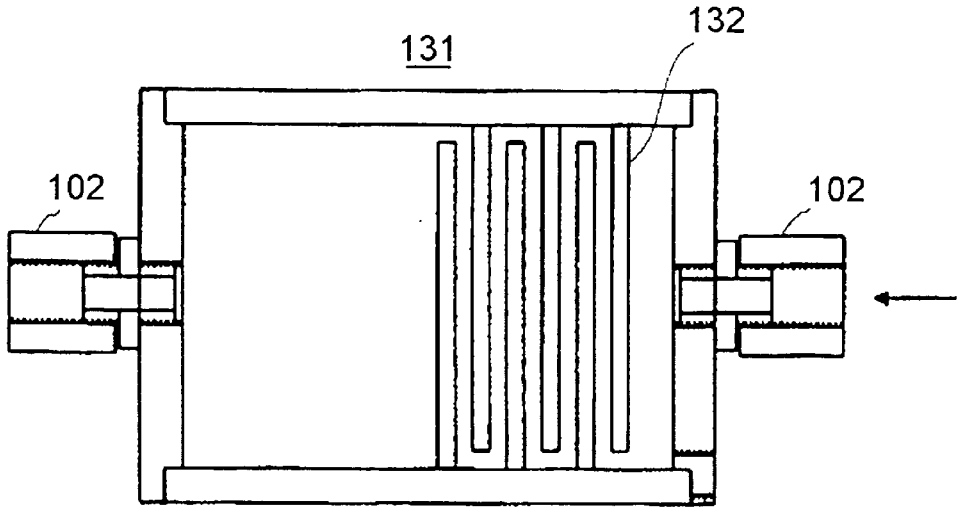
FIG. 10 is a cross sectional view of a liquifying device used in the second experiment.
Figure 11:
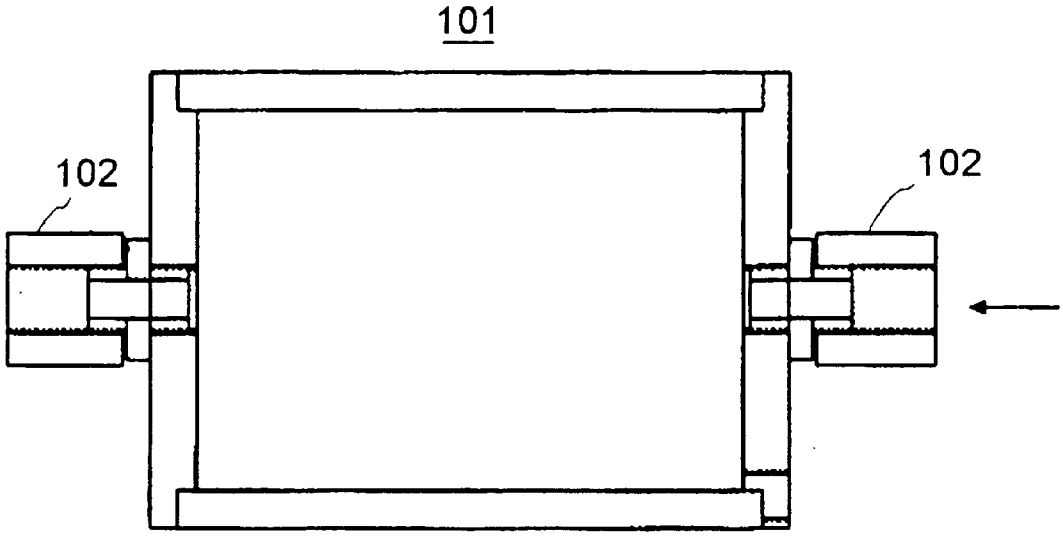
FIG. 11 is a cross sectional view of a liquifying device used in the second experiment.

FIGS. 9 to 11 are schematic views of the liquifying device used in this experiment.

A liquifying device 131 of a rectangular parallelopiped having inside dimensions of a width (distance between the pipes 102) of 150 mm and a sectional area (area of the connection face of each pipe) of 100 mm×100 mm is prepared, and pipes 102 with a sectional area of 100 $mm^2$ (inside dimensions) are connected to both ends of the liquifying device, and gas containing carrier liquid vapor flows from one of the pipes 102 at a rate of 25 liters per minute (flow rate of carrier liquid vapor 0.5 g/minute) and is ejected from the other pipe 102.

In the first experiment, as shown in FIG. 9, 12 zigzag walls 132 are formed over all the liquifying device at even intervals, and the flow path in the liquifying device is made longer, and many meandering chances of gas are set.

In the second experiment, as shown in FIG. 10, 5 zigzag walls 132 are formed only in a half area of the liquifying device and the meandering number of times of the flow path is reduced.

The structure of the third experiment is the same as that of the first embodiment of the present invention. Namely, as shown in FIG. 11, no zigzag walls are provided in the liquifying device 101.

In the fourth experiment, as shown in FIG. 11, no zigzag walls are provided in the liquifying device 101 and the sectional area of the liquifying device is 100 mm×50 mm.

Further, although not shown in the drawing, for comparison, a liquifying device having a structure that the pipes 102 are connected with a pipe having the same sectional area is prepared.

Using these liquifying devices, the ratio of carrier liquids collecting the liquifying devices is measured.

The ratio of carrier liquids collecting the liquifying devices is 70% in the first experiment, 40% in the second experiment, 30% in the third experiment, 10% in the fourth experiment, and 2% in the experiment using the liquifying device for comparison.

The reason that the carrier liquid is slightly liquified in the experiment using the liquifying device for comparison may be considered that a turbulent flow is generated at the connection of the pipes 102.

Further, whether water, that is, a water vapor component in gas is mixed in the collected carrier liquids is checked and no water is detected.

As describe above, according to the present invention, carrier liquid vapor can be removed without using a forced cooling device separately.

What is claimed as new and desired to be secured by Letters patent of the United States is:

1. A method of using an image forming apparatus including a rotary latent image holding device having a surface on which an electrostatic latent image is formed, a developing device for feeding a liquid developer containing toner particles and a carrier liquid to the electrostatic latent image thereby forming a visible image on the latent image holding device, and a transfer device for transferring the visible image to a transfer material, said method comprising the steps of:

storing the latent image holding device, the developing device, and the transfer device in a cabinet;

sucking gas containing vapor of the carrier liquid vaporized in the cabinet from one end of a pipe and ejecting the gas from another end of the pipe; and providing a liquifying device that is connected to the another end of the pipe and that has a sectional area 50 times or more of that of the pipe in a perpendicular direction to a moving direction of the vapor ejected from the pipe.

2. The method according to claim 1, further comprising the step of providing a carrier liquid ejection port for ejecting a carrier liquid liquified by the liquifying device on a bottom of the liquifying device.

3. The method according to claim 1, further comprising the step of preventing vapor of a carrier liquid from diffusing over the developing device and the transfer material.

4. The method according to claim 1, further comprising the steps of:

externally ejecting gas not liquified by the liquifying device using a fan; and adsorbing a non-liquified carrier liquid by installing an adsorption material between the fan and the liquifying device.

5. The method according to claim 1, further comprising the steps of:

providing a carrier liquid ejection port for ejecting a carrier liquid liquified by the liquifying device on a bottom of the liquifying device;

externally ejecting gas not liquified by the liquifying device using a fan; and adsorbing a non-liquified carrier liquid by installing an adsorption material between the fan and the liquifying device.

6. A method of using an image forming apparatus including a rotary latent image holding device having a surface on which an electrostatic latent image is formed, a developing device for feeding a liquid developer containing toner particles and a carrier liquid to the electrostatic latent image thereby forming a visible image on the latent image holding device, and a transfer device for transferring the visible image to a transfer material, said method comprising the steps of:

storing the latent image holding device, the developing device, and the transfer device in a cabinet;

providing a liquifying device having a suction port for sucking gas containing vapor of the carrier liquid vaporized in the cabinet and an ejection port for ejecting the gas after liquifying the vapor; and providing the liquifying device that internally has a plurality of zigzag walls for changing a moving direction of the gas introduced from the suction port and leading the gas to the ejection port.

7. The method according to claim 6, further comprising the step of arranging the plurality of zigzag walls so that surfaces in contact with the gas are parallel with a direction of gravity.

8. The method according to claim 6, further comprising the step of forming slits in the plurality of zigzag walls, wherein the slits have a perpendicular component to a moving direction of the meandering gas.

9. The method according to claim 6, further comprising the steps of:

arranging the plurality of zigzag walls so that surfaces in contact with the gas are parallel with a direction of gravity; and forming slits in the plurality of zigzag walls, wherein the slits have a perpendicular component to a moving direction of the meandering gas.

10. The method according to claim 6, further comprising the steps of;

providing an inclined surface on a bottom of the liquifying device; and providing a carrier liquid ejection port for ejecting a carrier liquid liquified by the liquifying device on a lowest part of the inclined surface.

11. The method according to claim 6, further comprising the steps of:

providing a carrier liquid ejection port for ejecting a carrier liquid liquified by the liquifying device on a bottom of the liquifying device;

externally ejecting gas not liquified by the liquifying device using a fan; and adsorbing a non-liquified carrier liquid by installing an adsorption material between the fan and the liquifying device.

12. A method for processing carrier vapor for an image forming apparatus using liquid developer, said method comprising the steps of:

sucking gas containing vapor of a carrier liquid vaporized in a cabinet of the image forming apparatus from one end of a pipe and ejecting the gas from another end of the pipe;

liquifying vapor of the vaporized carrier liquid using a liquifying device connected to the another end of the pipe; and ejecting the vapor not liquefied by the liquifying device using an ejection port.

13. The method according to claim 12, wherein the liquifying device is provided with a sectional area in a perpendicular direction to a moving direction of the vapor ejected from the pipe that is 50 times or more of a sectional area of the pipe.

14. The method according to claim 12, further comprising the step of providing a carrier liquid ejection port for ejecting a carrier liquid liquified by the liquifying device on a bottom of the liquifying device.

15. The method according to claim 12, further comprising the steps of:

externally ejecting gas not liquified by the liquifying device using a fan; and adsorbing a non-liquified carrier liquid by installing an adsorption material between the fan and the liquifying device.

16. The method according to claim 12, further comprising the step of providing the liquifying device internally with a plurality of zigzag walls for changing a moving direction of the gas introduced from the pipe and leading the gas to the ejection port.

17. The method according to claim 16, further comprising the step of arranging the plurality of zigzag walls so that surfaces in contact with the gas are parallel with a direction of gravity.

18. The method according to claim 16, further comprising the steps of:

arranging the plurality of zigzag walls so that surfaces in contact with the gas are parallel with a direction of gravity; and forming slits in the plurality of zigzag walls, wherein the slits have a perpendicular component to a moving direction of the meandering gas.

19. The method according to claim 16, further comprising the steps of;

providing an inclined surface on a bottom of the liquifying device; and providing a carrier liquid ejection port for ejecting a carrier liquid liquified by the liquifying device on a lowest part of the inclined surface.

20. The method according to claim 16, further comprising the steps of:

providing a carrier liquid ejection port for ejecting a carrier liquid liquified by the liquifying device on a bottom of the liquifying device;

externally ejecting gas not liquified by the liquifying device using a fan; and adsorbing a non-liquified carrier liquid by installing an adsorption material between the fan and the liquifying device.

* * * * *